United States Patent [19]

Yokomizo et al.

[11] 4,331,752

[45] May 25, 1982

[54] METHOD OF FORMING FLUORESCENT SCREENS OF COLOR PICTURE TUBES

[75] Inventors: Hiroshi Yokomizo; Masahiro Nishizawa; Yoshifumi Tomita; Kiyoshi Miura; Osamu Sasaya, all of Mobara, Japan

[73] Assignee: Hitachi, Ltd., Tokyo, Japan

[21] Appl. No.: 184,959

[22] Filed: Sep. 8, 1980

[30] Foreign Application Priority Data

Sep. 7, 1979 [JP] Japan ..... 54-114192

[51] Int. Cl.[3] ..... G03C 5/00

[52] U.S. Cl. ..... 430/28; 430/25; 430/26; 427/53.1; 427/68

[58] Field of Search ..... 430/25, 26, 28; 427/53.1, 68

[56] References Cited

U.S. PATENT DOCUMENTS 4,247,612 1/1981 Nishizawa et al. ..... 430/28
4,269,918 5/1981 Nonogaki et al. ..... 430/28
4,273,842 6/1981 Nonogaki et al. ..... 430/25

FOREIGN PATENT DOCUMENTS 53-126861 11/1978 Japan .

*Primary Examiner*—James R. Hoffman
*Attorney, Agent, or Firm*—Charles E. Pfund

[57] ABSTRACT

In a method of forming a fluorescent screen of a color picture tube by a dry process, the method comprises a first step of precoating an emulsion containing a powder of acryl resin on an inner surface of a face plate of the color picture tube to form a primary coating, a second step of coating on the primary coating a photosensitive composition consisting essentially of a diazonium salt to form a thin film, a third step of exposing to light a selected portion of the thin film to render the same to become adhesive, a fourth step of depositing a powder of a phosphor on the selected portion to form a phosphor layer of a first color and a fifth step of repeating the third and fourth steps to form phosphor layers of second and third colors.

2 Claims, No Drawings

METHOD OF FORMING FLUORESCENT SCREENS OF COLOR PICTURE TUBES

BACKGROUND OF THE INVENTION

This invention relates to a method of forming a fluorescent screen of a color picture tube, more particularly a method of forming a fluorescent screen of a color picture tube wherein powders of phosphors are coated on the inner surface of the face plate or panel of a color picture tube by so-called dry process.

The dry process was developed to replace conventional slurry process. According to the dry process, a photosensitive composition consisting essentially of an aromatic diazonium salt is used. When locally exposed to light, a film of this composition manifests a difference in the powder accepting capability between a portion exposed to light and a portion not exposed to light.

According to this method, a film of photosensitive substance is coated on the inner surface of the face plate, and the portions of the film at which phosphors of predetermined colors are to be coated are exposed to light through a color selection electrode such as a shadow mask to utilize a photoreaction created therein for the purpose of coating the phosphors. More particularly, a film of a photosensitive composition containing a diazonium salt as a major ingredient is coated on the inner surface of the face plate and portions of the film at which the phorphors are to be coated are exposed to light. Then zinc chloride formed in the exposed portions by photoreaction absorbs moisture in the atmosphere to become sticky so that when a powder of phosphors for emitting desired fluorescent colors is blasted onto the inner surface of the face plate, the phosphor powder will adhere only to the portions of the photosensitive composition film that have become sticky. After performing blasting and sticky coating of respective phosphors of three colors, the surface of the photosensitive composition film is treated with ammonia gas to render the portions of the photosensitive composition film to which the phosphor powder has been adhered to be insoluble in water, thereby fixing these portions. Then, the surface remainders are washed away with an organic solvent thus forming a fluorescent screen. When compared with the slurry type method in which phosphors of respective colors are formed as photosensitive slurried which are sequentially coated, exposed, washed with water and developed, this dry process is advantageous in that only one coating step of the photosensitive composition film is sufficient, that is it is possible to blast the phosphors in the form of a powder, and that surplus phosphor powders that had not adhered can be blown away with air spray for recovery purpose, thus increasing the efficiency of utilization of the phosphors. Such dry method is disclosed, for example, in Japanese Preliminary Publication of patent No. 126,861 of 1978 published on Nov. 6, 1978 invented by Saburo Nonogaki et al, and corresponding to U.S. patent application Ser. No. 895,372 filed on Apr. 11, 1978, now U.S. Pat. No. 4,273,842.

Irrespective of the advantage described above, in the dry process there is a problem that the powder of phosphors applied in the succeeding step tends to adhere to the peripheries of the phosphor powders coated in the preceding step. More particularly, in the step of forming the phosphor film of a first color in which portions to be exposed are caused to absorb moisture in the air to become adhesive and the phosphor powder of the first color is caused to adhere to such moisture adsorbed peripheries. However, since the photosensitive film itself is water soluble, the moisture is adsorbed only in the peripheral portion of the film to be exposed to cause the peripheral portion to become adhesive. Accordingly, after light exposure, when the phosphor powder of a second phosphor is coated on the exposed portion for the purpose of forming the phosphor film of the second color, the phosphor powder of the second color would adhere only to the peripheries of the portions coated with the phosphor of the first color. In the same manner, in the step of forming the phosphor film of a third color, the phosphor powder of the third color would adhere to the peripheries of the portions coated with the first and second colors. Ooze of the moisture causes so-called blurring or fogs in which powders of the phosphor adhere to not exposed portions, thereby degrading the color purity of the color picture tube.

SUMMARY OF THE INVENTION

Accordingly, it is an object of this invention to provide an improved method of forming a fluorescent screen of a color picture tube capable of preventing the fogging phenomena caused by deposition of phosphors of other colors at unwanted portions on the peripheries of a phosphor of another color coated by the dry process thus improving the color purity of the color picture tube.

Briefly stated, according to this invention, an emulsion of an acrylic resin is precoated prior to the coating of the photosensitive composition on the inner surface of the face plate of a color picture tube.

According to this invention, there is provided a method of forming a fluorescent screen of a color picture tube comprising a first step of precoating an emulsion containing a powder of acryl resin on an inner surface of a face plate of the color picture tube to form a primary coating, a second step of coating on the primary coating a photosensitive composition consisting essentially of a diazonium salt to form a thin film, a third step of exposing to light a selected portion of the thin film to render the same to become adhesive, a fourth step of depositing a powder of a phosphor on the selected portion to form a phosphor layer of a first color, and a fifth step of repeating the third and fourth steps to form phosphor layers of second and third colors.

DESCRIPTION OF THE PREFERRED EMBODIMENT

We have tried various modifications of the prior art manufacturing steps for overcoming the difficulty described above, and found that precoating of an emulsion of an acrylic resin, particularly an emulsion containing a polymer of an acrylic ester is effective to prevent ooze of the moisture that has been absorbed by portions of the photosensitive composition to be exposed, which is efficient to improve the color purity of the color picture tube. For the purpose of forming a homogeneous film, it is advantageous to use an acryly resin emulsion having a small particle size of from 0.5 to 0.01 micron and a relatively low minimum film forming temperature (MFT). Particle size larger than 0.5 microns results in nonuniform coating. Examples of such acrylic resin emulsion are Primal B-74, Primal C-72, Primal AC-33 and Primal AC-34 manufactured by Nippon Acryl Co.

To have better understanding of the invention, the following examples are given.

EXAMPLE 1

1% by weight of the Primal—74 manufactured by the Nippon Acryl Co. and having a particle size of 0.01 to 0.1 micron, 0.15% by weight of polyvinyl alcohol, 0.15% by weight of colloidal silica and the remainder of water were mixed together to prepare a solution. The polyvinyl alcohol and colloidal silica are used for the purpose of improving homogeneousness. The solution was then uniformly coated on the inner surface of the face plate of a 14" type color picture tobe with a rotary coating method to form a primary coating having a thickness of 0.2 to 0.3 micron. Then the primary coating was heated to a temperature near the MFT with infrared rays. The MFT of Primal B-74 is about 41° C.

Then a solution of a photosensitive composition was prepared by admixing 0.6% by weight of propylene glycol alginate 3.0% by weight of para-dimethyl aminobenzene diazodium zinc chloride, 0.003% by weight of Pluronic-L-92 (block copolymer of propylene glycol and ethylene oxide, manufactured by Wyandotte Chemical Co.) and the remainder of water, and the solution was uniformly coated on the inner surface of the face plate to form a thin layer of the photosensitive composition having a thickness of about 0.6 to 1.0 micron on the primary coating. After drying the film, a shadow mask was combined with the face plate. Then light having an intensity of 15 to 20 $W/m^2$ was projected for 2 to 3 minutes through the shadow mask upon a portion of the photosensitive layer on which a green phosphor is to be deposited.

The diazonium salt at the exposed portion of the photosensitive film undergo decomposition owing to the light exposure to form zinc chloride which then absorbs moisture in the air to become sticky.

After blasting a powder of green color phosphor upon the photosensitive film air is blasted to remove surplus power whereby the green color phosphor is left to a thickness of 3 to 3.5 $mg/cm^2$ at only the portion of the photosensitive film which became sticky as a result of the light exposure. Such exposure, phosphor blasting and air blasting steps were repeated for blue and red color phosphors to form dots or stripes of three colors on the inner surface of the face plate which are free from fogs caused by phosphors of other colors which have been coated previously. It should be noted that aforementioned primary coating and the photosensitive composition layer are evaporated off by a later baking step necessary to manufacture a color picture tube.

EXAMPLE 2

A solution was prepared by admixing 1% by weight of Primal C-72 manufactured by Nippon Acryl Kabushiki Kaisha and having a particle size of about 0.3 microns, 0.15% by weight of polyvinyl alcohol, 0.15% by weight of colloidal silica and the remainder of water. Then the solution was coated on the inner surface of the face plate of a color picture tube to form a primary coating having a thickness of 0.2 to 0.3 microns. Thereafter, the same steps as in Example 1 were followed. The Primal C-72 had a MFT of about 39° C. The fluorescent screen thus obtained did not show any fog described above.

EXAMPLE 3

A solution was prepared by admixing 1% by weight of Primal AC-33 manufactured by Nippon Acryl Kagaku Kabushiki Kaisha and having a particle size of about 0.3 microns, 0 to 15% by weight of polyvinyl alcohol, 0.15% by weight of colloidal silica and the balance of water. The solution was then coated on the inner surface of the face plate of a color picture tube to form a primary coating of a thickness of 0.2 to 0.3 microns. Thereafter the same steps as in Example 1 were followed. The Primal AC-33 had a MFT of about 8° C. The resulting fluorescent screen was free from any fog.

EXAMPLE 4

A solution was prepared by admixing 1% by weight of a powder of Primal AC-34 manufactured by Nippon Acryl Kagaku Kabushiki Kaisha and having a particle size of about 0.3 micron, 0.15% by weight of polyvinyl alcohol, 0.15% by weight of colloidal silica and the remainder of water. The solution was then coated on the inner surface of the face plate of a color picture tube to form a primary layer having a thickness of 0.2 to 0.3 microns. Succeeding process steps were the same as those of Example 1. The Primal AC-34 had an MFT of about 12° C. The fluorescent screen thus obtained was free from any fog described above.

According to the method of forming the fluorescent screen of a color picture tube according to this invention, it is possible to form by simple steps phosphors of three colors at correct positions without accompanyed by unwanted fogs of a phosphor of one color previously coated caused by phosphors of the other colors thus greatly improving the color purity of the color picture tube.

It should be understood that the invention is not limited to the specific examples described above and that many changes and modifications would be obvious to one skilled in the art. For example, the invention is also applicable to a case wherein a fluorescent of a color picture tube of the black matrix type is formed by the dry process.

What is claimed is:

1. A method of forming a fluorescent screen of a color picture tube comprising:

a first step of precoating an emulsion containing a powder of acryl resin on an inner surface of a face plate of the color picture tube to form a primary coating;

a second step of coating on said primary coating a photosensitive composition consisting essentially of a diazonium salt to form a thin film;

a third step of exposing to light a selected portion of said thin film to render the same to become adhesive;

a fourth step of depositing a powder of a phosphor on said selected portion to form a phosphor layer of a first color; and a fifth step of repeating the third and fourth steps to form phosphor layers of second and third colors.

2. The method according to claim 1 wherein said powder of acryl resin had a particle size of from 0.5 to 0.01 microns.

* * * * *